US005971642A

United States Patent [19]

O'Mara et al.

[11] Patent Number: 5,971,642

[45] Date of Patent: Oct. 26, 1999

[54] WRITING INSTRUMENT WITH FINGER RETAINER

[75] Inventors: John O'Mara, Conway Springs; Ralph Lagergren, Winfield, both of Kans.

[73] Assignee: Northstar, LP, Winfield, Kans.

[21] Appl. No.: 09/155,083

[22] PCT Filed: Mar. 18, 1997

[86] PCT No.: PCT/US97/04202

§ 371 Date: Sep. 18, 1998

§ 102(e) Date: Sep. 18, 1998

[87] PCT Pub. No.: WO97/34771

PCT Pub. Date: Sep. 25, 1997

Related U.S. Application Data

[60] Provisional application No. 60/013,670, Mar. 19, 1996.

[51] Int. Cl.[6] ..... A46B 5/02

[52] U.S. Cl. ..... 401/8; 401/6; 401/7; 15/443

[58] Field of Search ..... 401/6, 7, 8; 15/437, 15/443; 224/217, 251, 918

[56] References Cited

U.S. PATENT DOCUMENTS

| | | | |
|---|---|---|---|
| 343,391 | 6/1886 | Peiter | 401/8 |
| 558,902 | 8/1896 | Einfeldt et al. | 401/8 |
| 2,709,419 | 9/1954 | Appel | 15/443 |
| 3,075,498 | 1/1963 | Udcoff | 15/443 |

FOREIGN PATENT DOCUMENTS

| | | | |
|---|---|---|---|
| 2461387 | 7/1976 | Germany | 401/8 |
| 709081 | 1/1980 | U.S.S.R. | 401/8 |
| 1340389 | 12/1973 | United Kingdom | 401/8 |

*Primary Examiner*—Henry J. Recla
*Assistant Examiner*—Khoa Huynh
*Attorney, Agent, or Firm*—James E. Bradley

[57] ABSTRACT

A writing instrument with a finger retainer has a short-barreled writing instrument permanently mounted onto a finger retainer. The short-barreled writing instrument has opposing concave sides conforming to the wearer's fingers and a shoulder for the wearer to press against while writing. The short-barreled writing instrument has a flange permanently mounted onto a finger retainer.

13 Claims, 3 Drawing Sheets

WRITING INSTRUMENT WITH FINGER RETAINER

This application claims benefit of provisional application Ser. No. 06/013,670 filed Mar. 19, 1996. This application is also a 371 of PCT/US97/04202 filed Mar. 18, 1997.

TECHNICAL FIELD

The present invention relates to new and useful improvements for writing instruments and more particularly to short-barreled writing instruments permanently mounted to finger retainers.

BACKGROUND ART

Various finger-mounted writing instrument holders have been developed or patented to be worn on the wearer's thumb, index, or second finger. Few of these ring-mounted holders have the writing instrument permanently mounted to or integrally formed with the holder for the fingers. Holders that have permanently mounted writing instruments have narrow, uncomfortable bands for retaining the writing instrument on the wearer's finger. Typically, the narrow retaining band must be adjusted to fit the wearer's finger. The band must also be worn at a particular location on the finger. Prior art types do not allow the user to easily perform tasks other than writing, with the retaining band still in place, such as typing, keyboarding on a computer or filing.

DISCLOSURE OF INVENTION

The general object of the invention is to provide a writing instrument with a finger retainer wherein a short-barreled writing instrument is permanently mounted onto a finger retainer which is convenient, comfortable and easily used. The present invention utilizes a short-barreled writing instrument with a writing implement such as a pen or pencil so that it is convenient for the wearer to perform other functions such as typing or filing while wearing the invention. The short-barreled writing instrument has opposing concave sides conforming to the wearer's knuckles and a shoulder for the wearer to press against while writing. The short-barreled writing instrument is permanently mounted onto a finger retainer. The finger retainer is self-adjusting to provide a snug, comfortable fit on the middle finger.

BEST MODE FOR CARRYING OUT THE INVENTION

Figure 1:
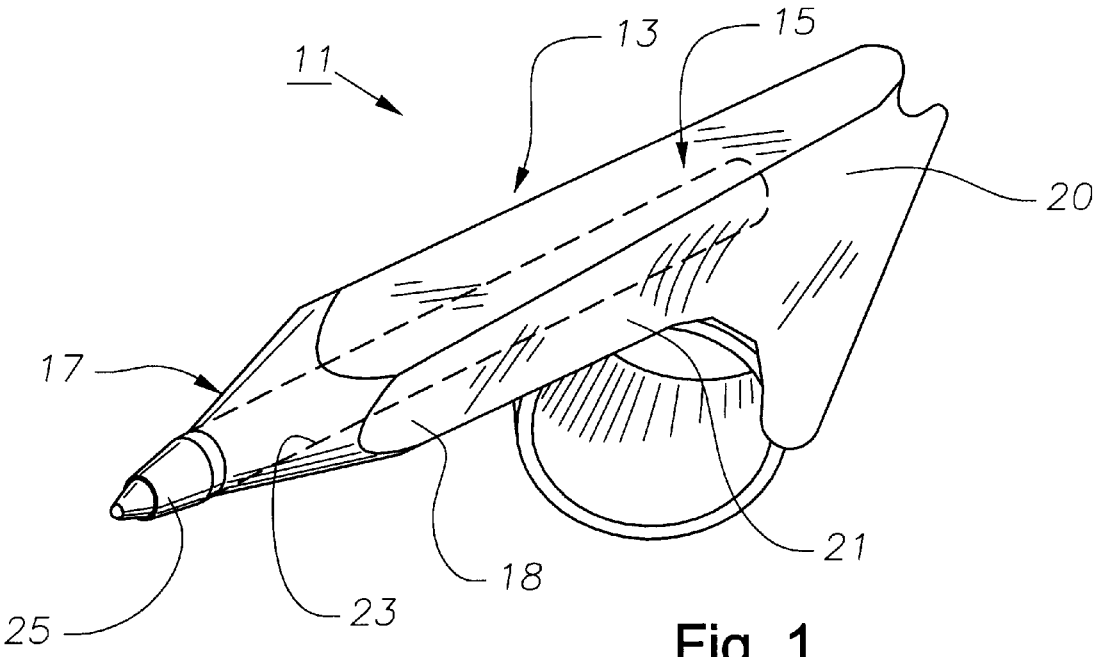
FIG. 1 is a upper perspective view showing a writing instrument constructed in accordance with the invention.
Figure 2:
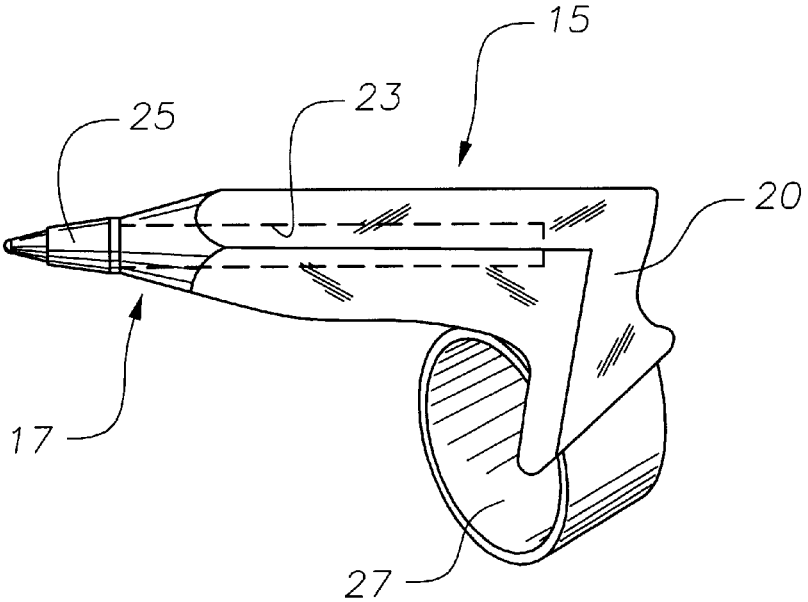
FIG. 2 is a left side view of the writing instrument of FIG. 1.
Figure 3:
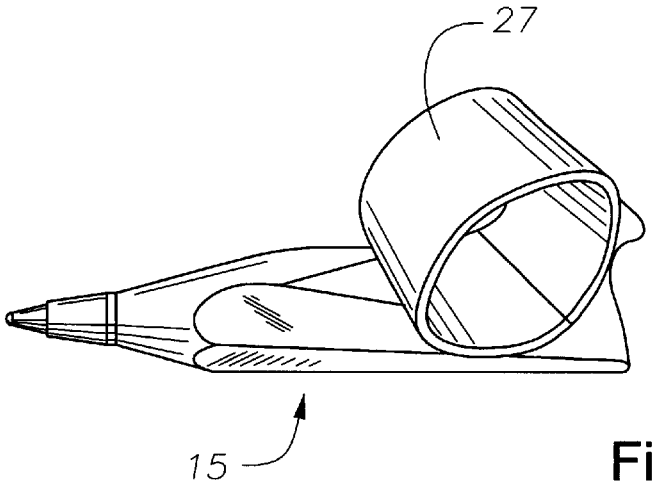
FIG. 3 is a top view of the writing instrument of FIG. 1.
Figure 4:
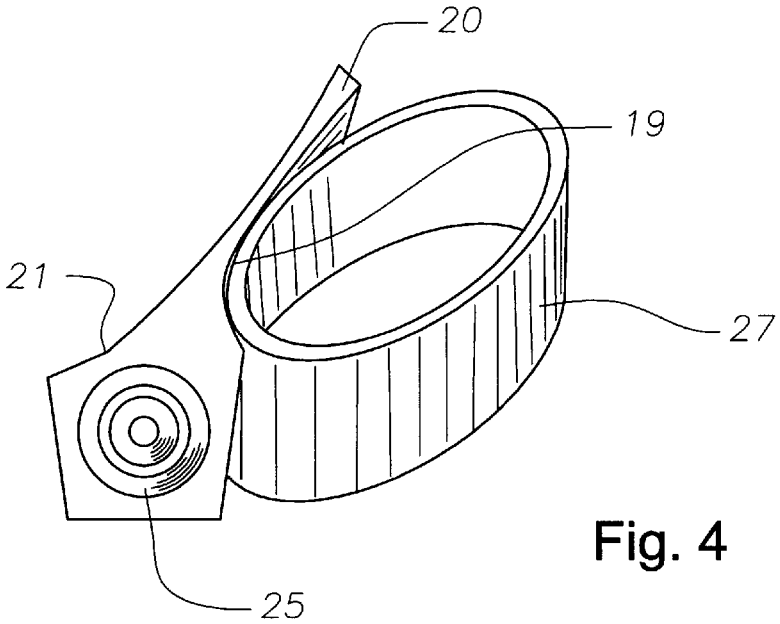
FIG. 4 is a front view of the writing instrument of FIG. 1.

Referring to FIGS. 1–7, a writing instrument 11 having a short-barreled writing element 13 is shown. Writing element 13 has a body portion 15, a conical tip or head portion 17, a shoulder 18 therebetween, and a flange 20 extending radially away from a rearward end. Body portion 15 has a length of approximately 2.25 inches and a width of 0.375 inches. Flange 20 has two concave, longitudinal sides 19, 21 located opposite of one another. Side 19 is referred to as an outer side, and side 21 is referred to as an inner side. "Concave" is used generally to refer to a shallow depression and not just part of a spherical surface. The concave portion of side 21 is partly on flange 20 and partly on body 15. Shoulder 18 is a shallow curved area on a forward portion of concave side 21 and extends from head portion 17 in a rearward direction. As shown in FIG. 3, body 15 tapers in width from the forward end to the rearward end. A hollow cylindrical bore 23 extends through the head portion 17 and a selected distance into the body portion 15 of writing element 13. Writing element 13 is preferably made of thermoformed plastic but can be made of wood, metal or any other rigid material.

A writing implement 25 is inserted into the hollow cylindrical bore 23 and permanently secured by a bonding agent such as glue or epoxy (not shown), or by temporary means such as a press fit or threaded screw fit. The preferred writing implement 25 is a ballpoint pen, but may also be a pencil.

Writing instrument 11 is assembled by permanently mounting a tubular finger retainer 27 to concave side 19 toward the rearward end of body 15. Retainer 27 is secured with a thin layer of bonding agent such as glue or epoxy, a snap, or a tab system (not shown). Retainer 27 is a cylindrical band and of sufficient elasticity to provide a snug fit without hindering the wearer's circulation. Retainer 27 has a circumference of approximately 2.5 inches and an approximate width of 0.5 inches. Retainer 27 may comprise other materials such as hook and loop tape. The flexibility of retainer 27 allows body portion 15 and writing implement 25 to rotate a limited extent for better positioning. The rearward end of writing element 13 is located approximately at the rearward edge of retainer 27. Body 15 also has a billboard side 29 that may be used for advertising. Billboard side 29 is always in sight of the user.

Figure 5:
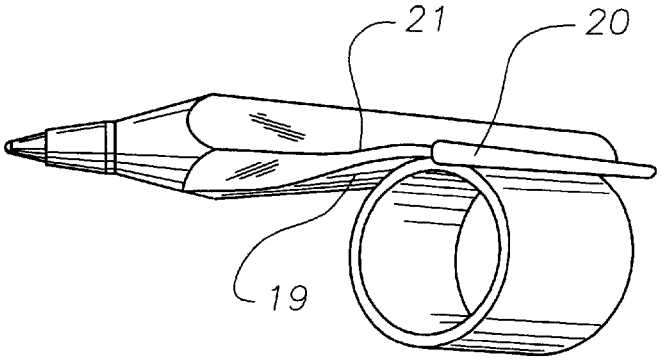
FIG. 5 is a bottom view of the writing instrument of FIG. 1.

The wearer inserts the middle finger of his writing hand through finger retainer 27 and slides retainer 27 to a position between the first and second knuckles. In its natural configuration, FIG. 5 shows that the axis of body 15 is slightly skewed to the axis of retainer 27 in order to allow writing implement 25 to be positioned at an unobtrusive angle away from the direction of the user's fingers when not in use and allow the user to place writing implement 25 in a better writing position when in use. The wearer rotates the writing element toward the palm of the hand when in use. When writing element 13 is in line with the middle finger, head portion 17 is adjacent to the tip of the inserted finger. This allows writing implement 25 to extend past the tip of the middle finger.

Figure 6:
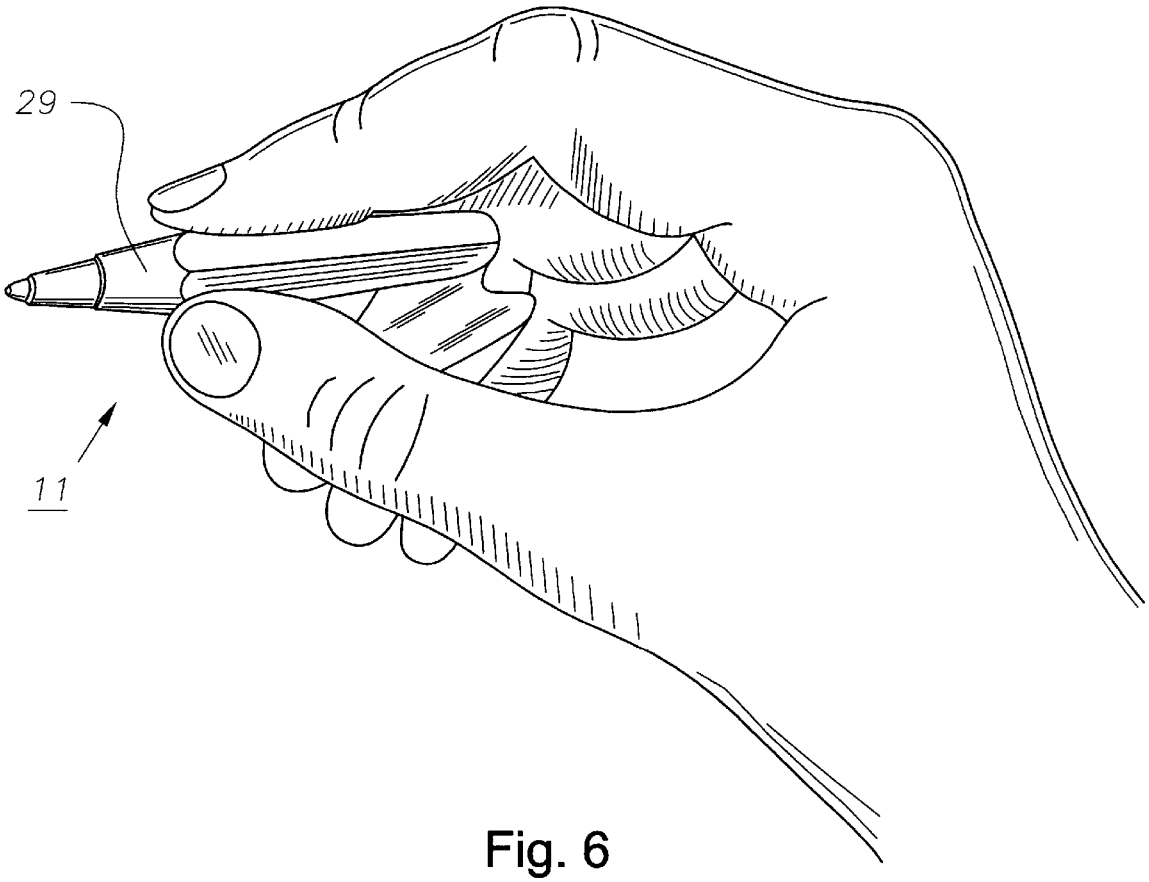
FIG. 6 is a schematic view showing the writing instrument of FIG. 1 during use.
Figure 7:
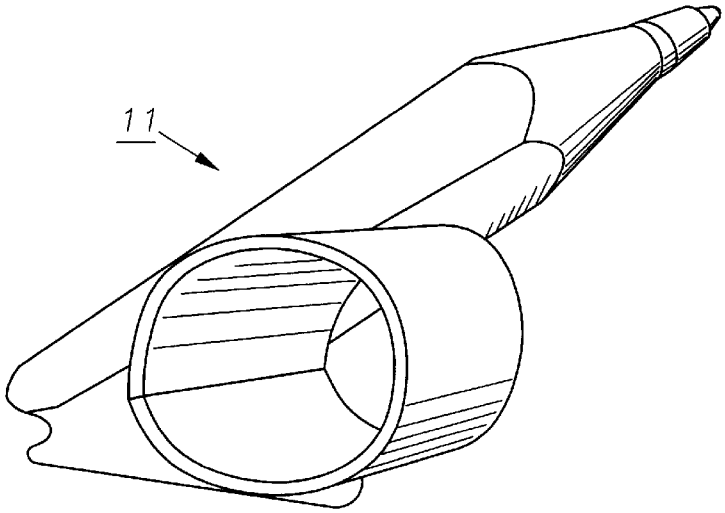
FIG. 7 is a lower perspective view of the writing instrument of FIG. 1.

Referring to FIG. 6, the wearer squeezes opposing concave sides 19 and 21 between the middle finger and thumb, respectively. The thumb rests against shoulder 18 and pushes outward and downward against body 15. The index finger is placed on an upper side of body 15. Pressure from the tips of the fingers and thumb against shoulder 18 prevents slippage. The middle finger causes tension in the tubular finger retainer 27 and a snug fit around the middle finger is attained. The concave sides 19 and 21 of writing element 13 conform to the middle finger to provide comfort while in use. The elasticity of finger retainer 27 allows writing element 13 to be adjusted to various angles with respect to the middle finger, thereby allowing the wearer to perform other tasks such as typing, filing, or other office functions while the writing instrument is not in use. Writing instrument 11 may be worn with the writing element on the palm side of the hand to facilitate use by wearers with limited movement of the fingers, such as those with arthritis. In the embodiment shown, writing instrument 11 is discarded when writing implement 25 runs out of ink, or implement 25 can be replaced in instrument 11.

The embodiment of FIGS. 1–7 is designed for a right-handed user. However, the invention may be configured for a left-handed user by reversing the positions of retainer 27, concave sides 19, 21, and shoulder 18 to the opposite side of body 15.

The invention has several advantages. The flexible, elastic band is easily secured to and removed from the finger and is adjustable to fit different finger sizes. The writing element is very short and is angled away from the direction of the fingers to minimize interference with non-writing tasks even while being worn. The writing instrument is permanently mounted to the body and is ergonomically shaped.

It should be apparent from the foregoing that an invention having significant advantages has been provided. While the invention is shown in only one of its forms, it is not so limited but is susceptible to various changes and modifications without departing from the spirit thereof.

We claim:

1. A writing instrument, comprising:

a rigid body having a cylindrical axial bore and a flange integrally formed with and extending laterally away from the body having at least one concave side for conforming to a user's middle finger;

a writing element located within the bore of the body; and a flexible band attached to the concave side of the flange for removably securing the writing instrument to a finger.

2. The writing instrument of claim 1 wherein the body has a maximum length of about 2.25 inches and a maximum width of about 0.375 inches.

3. The writing instrument of claim 1 wherein the band is elastic.

4. The writing instrument of claim 1 wherein the writing element is a ballpoint pen.

5. The writing instrument of claim 1, further comprising a second concave side for pressing a thumb against, the second concave side being located on an opposite side to said at least one concave side.

6. The writing instrument of claim 1 wherein the at least one concave side comprises a flange integrally formed with and extending laterally away from a rearward portion of the body.

7. The writing instrument of claim 1 wherein the band has a longitudinal axis which is skewed relative to the axial bore of the body when the band is in an undeformed condition.

8. A writing instrument, comprising:

a rigid body having a writing element located therein, a flange integrally formed with and extending laterally from a rearward portion of the body and having inner and outer concave surfaces located on opposite sides of the flange for gripping the body between a thumb and a finger; and a flexible, elastic band attached to the flange for securing the writing instrument to a finger.

9. The writing instrument of claim 8 wherein the body has a tip on a forward end, a shoulder joining the tip and a rearward end, the body tapering in width from the shoulder to the rearward end.

10. The writing instrument of claim 8 wherein the body has a rearward end which is located substantially where the band is connected.

11. The writing instrument of claim 8 wherein the band has a longitudinal axis which is skewed relative to the writing element when the band is in an undeformed condition for causing the body to be at an angle relative to a user's middle finger while the writing instrument is being worn but not being used.

12. The writing instrument of claim 8 wherein the body has a maximum length of about 2.5 inches.

13. A method for writing by hand, comprising:

providing a rigid body having a writing element therein with a tip at a forward end of the body, the body having a flange and an elastic band secured to said flange;

inserting a middle finger of the hand into the band and positioning the band between a first and second knuckle of the middle finger;

pressing against the body with a thumb of the hand on a side opposite of the concave surface;

pressing downward on the body adjacent to the tip with the index finger; then moving the hand to write.

* * * * *